US005082292A

United States Patent [19]

Puckett et al.

[11] Patent Number: 5,082,292

[45] Date of Patent: Jan. 21, 1992

[54] BROADHEAD WITH DEPLOYABLE CUTTING BLADES

[75] Inventors: Riley Puckett, Lorton; Wayne Bell, Annandale, both of Va.

[73] Assignee: Pucketts Bloodtrailer Broadhead, Lorton, Va.

[21] Appl. No.: 637,491

[22] Filed: Jan. 3, 1991

Related U.S. Application Data

[63] Continuation-in-part of Ser. No. 460,299, Jan. 3, 1990, Pat. No. 4,998,738.

[51] Int. Cl.[5] ..... F42B 6/08

[52] U.S. Cl. ..... 273/421

[58] Field of Search ..... 273/416, 419, 421, 422

[56] References Cited

U.S. PATENT DOCUMENTS

| | | | |
|---|---|---|---|
| 2,859,970 | 11/1958 | Doonan | 273/421 |
| 3,138,383 | 6/1964 | McKinzie | 273/421 |
| 4,166,619 | 9/1979 | Bergmann | 273/421 X |
| 4,504,063 | 3/1985 | LeBus | 273/422 |
| 4,579,348 | 4/1986 | Jones | 273/421 |
| 4,932,671 | 6/1990 | Anderson, Jr. | 273/421 |
| 4,976,443 | 12/1990 | DeLucia | 273/421 |

*Primary Examiner*—Edward M. Coven
*Assistant Examiner*—William E. Stoll
*Attorney, Agent, or Firm*—Whitham & Marhoefer

[57] ABSTRACT

A broadhead (10) has deployable cutting blades (24 and 26) which are cammed open from slots (20 and 22) in a cylindrical body (14) as plunger (12) impacts against a game animal. The cutting blades (24 and 26) are connected by pivot pins (32 and 34) to the plunger (12). The cutting blades (24 and 26) are pivotable when the broadhead (10) is in an open position from the open, cutting configuration which causes maximum hemorrhaging to a non-barbed configuration which complies with various state gaming laws. A tubular restraint (11) serves to hold the cutting blades (24 and 26) within their respective slots (20 and 22) during the flight of the arrow. The cylindrical body (14) is threadably (60) connected to a cap (28) and the body (14) and cap (28) include matching tapered sections (64 and 66, respectively) which allow for improved sliding of the plunger (12) through the body (14). A pin (44) has been provided as a camming surface for lower blades (26) to improve the manufacturability of the broadhead (10).

3 Claims, 5 Drawing Sheets

BROADHEAD WITH DEPLOYABLE CUTTING BLADES

CROSS-REFERENCE TO RELATED APPLICATIONS

This patent application is a continuation-in-part (CIP) application of the co-pending patent application having Ser. No. 07/460,299 entitled "Broadhead Hunting Arrow" which was filed on Jan. 3, 1990 and which issued as U.S. Pat. No. 4,998,738. That patent being herein incorporated by reference.

This patent application is related to the co-pending patent application having Ser. No. 07/631,646 entitled "Broadhead Hunting Arrow" which is a continuation application of Ser. No. 07/460,299 and was filed on Dec. 21, 1990, and is related to the co-pending patent application having Ser. No. 07/632,232 entitled "Tubular Restraint for Broadhead with Deployable Blades" which was filed on Dec. 21, 1990. Both of said applications are herein incorporated by reference.

BACKGROUND OF THE INVENTION

1. Field of the Invention

The subject invention is directed to a broadhead used on a hunting arrow wherein the cutting blades of the broadhead are kept in a retracted position within or close to a cylindrical body during the flight of the arrow, but, upon striking an animal, the cutting blades are opened to cause extensive damage to the animal.

2. Description of the Prior Art

Broadheads have been used for many years for hunting game animals such as deer. A broadhead is a particular type of arrow head which has outwardly extending blades that are designed to inflict more extensive damage to the animal. An objective for any broadhead is to have the animal killed as quick as possible such that the animal will not suffer for a long period of time and so that the animal will be recoverable by the hunter. Hunting regulations in certain states within the United States require broadheads to be of a specific size that will ensure killing the animal quickly such that the hunter does recover his quarry and will report the kill to the appropriate officials. Broadheads having smaller than the legal width generally do not inflict as much damage and result in slower bleeding. The illegal broadheads do not kill the animal as fast, yet they do mortally wound the animal; hence, the hunter using the illegal broadhead typically loses his prey and does not report the kill. Accurate harvesting records which reflect all kills ensure better wildlife management.

Today's hunting arrows typically comprise an aluminum or graphite shaft on which the broadhead body is threadably mounted. In many prior art broadheads, the blades are secured on the arrow in a fully open position, i.e., they are clipped to the sides or integrally formed with the body that is secured to the arrow shaft. It has been found that the flight of the arrow is adversely affected by wind resistance acting against the exposed broadhead blades. For example, broadheads with fixed blades tend to be less accurate because of wind current deflection and tend to have less velocity because of increased drag. Therefore, design efforts for modern broadheads typically have focussed on decreasing the wind effects to ensure a more accurate and effective broadhead.

U.S. Pat. No. 4,504,063 to LeBus discloses a broadhead hunting arrow which is designed to have the blades positioned in a narrower profile during flight and to have the blades moved to an expanded position when the arrow strikes the animal. A plunger tip positioned at the front of the broadhead is supposed to move towards the blades upon impact and cause a mass connected at the opposite end of the plunger to move within the hollow body and act against an inside surface of each of the blades. The inside surface of each of the blades is shaped such that the mass forces the blades outward when the plunger is forced rearward. One problem with the LeBus broadhead is that it is designed to always have some portion of the blades exposed; therefore, the effects of wind resistance are not completely avoided. Another problem with the LeBus broadhead is that there is no provision for preventing the main stem from riding up on the plunger and causing the blades to open during flight. Today's bows typically launch an arrow at a rate of 250 feet per second (fps) which may be a speed sufficient to cause the blades to open simply by the dead weight inertia of the mass within the hollow body relative to the quickly moving shaft.

U.S. Pat. No. 2,859,970 to Doonan discloses an arrow head designed to have cutting blades retracted within a cone at the front of the arrow during flight, yet have the cutting blades open upon impact with the animal. Doonan discloses that having fully retracted blades during flight avoids the adverse wind effects such as deflection of the arrow in an undesired direction and decreased flight velocity; however, problems with the Doonan arrow head would make it unacceptable for today's bow equipment. The cone shaped unit of Doonan is positioned on the front of an arrow with a target point and is held by a frictional fit or by riding in grooves on the shaft of the arrow. A pair of cutting blades are secured to a pivot pin within the cone body. The cutting blades are bowed slightly such that they will be frictionally held within the slots of the cone body during flight. The proposed operation is that the target point of the arrow acts as a ramming surface against the backside of the retracted blades and forces the blades open when the animal is struck by the arrow. One problem with the Doonan design is that it relies on the arrow shaft to open the blades. In today's equipment, the broadhead is threadably secured to the arrow shaft, not frictionally fit on the front end of a target arrow; therefore, there is no way for the shaft to provide any ramming action against a pair of retracted blades. Moreover, Doonan's frictional fit design may allow a deer to pull the arrow shaft, without the cone shaped tip, out of its body after being struck, thereby closing the wound and decreasing the bleeding. With a modern, threaded together, broadhead hunting arrow, the deer could not pull the shaft out of its body without also pulling out the broadhead. Another problem with the Doonan design is that the amount of frictional engagement between the slightly bowed cutting blades and the slots in the cone shaped body is not easily regulated and may be insufficient to hold the blades in their retracted position during flight. Moreover, an arrow shot at 250 fps should have sufficient velocity to open the blades fully in flight, i.e., Doonan's arrow head would not work with modern equipment since the target arrow head would be driven into the backside of the blades simply by the speed and force of today's bows.

U.S. Pat. No. 4,932,671 to Anderson discloses a phantom bladed broadhead which is designed to have the cutting blades retracted into a slot in a cylindrical body during the flight of the arrow and have the cutting blades forced open upon impact with an animal. The cutting blades each have a specially notched upper portion which is hung on a ring which encircles the cutting blades. A plunger mounted at the forward end of the cylindrical body has a ramming surface on its rear end which forces the blades open as the plunger is pushed into the cylindrical body when the arrow strikes an animal.

The Forestline company is currently selling a broadhead called the Punchcutter TM which includes a pair of cutting blades pivotally mounted inside a body towards its rear portion. In the Punchcutter TM, a plunger extending from the front of the body rams the front tips of the blades outward when an animal is struck by the arrow and the blades open wider by pivoting from the rear of the broadhead as the arrow is pushed through the body of the animal.

SUMMARY OF THE INVENTION

It is therefore an object of this invention to provide a broadhead which has retracted blades during flight and open blades upon impact with an animal that overcomes the disadvantages of prior art broadheads with deployable blades.

According to the invention, a broadhead has been designed with four cutting blades that are retracted within a cylindrical body during flight and are locked open upon impact with an animal. The tip of the broadhead is a plunger which slides within the cylindrical body. The cap and body have been provided with bevelled edges to improve the ability of the plunger to freely slide within the body. The four cutting blades are connected to the plunger via pivot pins. Preferably the four cutting blades are arranged as upper and lower pairs and are positioned at 90° increments around the plunger. Each pair of cutting blades fits within a slot that passes through opposite sides of the cylindrical body and is packed on a pivot pin with a flexed washer between each blade. When the plunger is fully extended (i.e., the in flight position), the blades are held within the slots by the biasing force of the flexed washer. Upon impact with an animal, the plunger is driven towards the rear of the cylindrical body and consequently forces the back side of each blade against camming surfaces formed inside the cylindrical body. At impact, the blades are cammed outward from the slot and are positioned to cause extensive damage to the animal. A C-shaped ring, positioned to ride on the outside surface of the plunger, locks the blades open when it falls into a channel encircling the plunger near the pointed tip. In order to comply with various state gaming laws, the blades are permitted to pivot from a barbed profile after they have been opened. A second channel may be formed around the plunger just above the position of the first pair of cutting blades to interact with the C-shaped ring while the arrow is in flight and hold the plunger tip in its fully extended position. Alternatively or in addition to the C-shaped ring which rides on the plunger, a rubber or plastic tubular member may be positioned so that it encircles the cylindrical body when the blades are in their retracted configuration and serves the function of holding the blades within there retracted position while the arrow is in flight. Upon impact with an animal, the cutting blades are forced outward and cut through the rubber or plastic tubular member.

BRIEF DESCRIPTION OF THE DRAWINGS

The foregoing and other objects, aspects and advantages of the invention will be better understood from the following detailed description of the preferred embodiments of the invention with reference to the accompanying drawings, in which.

DETAILED DESCRIPTION OF THE PREFERRED EMBODIMENTS OF THE INVENTION

Figure 1:
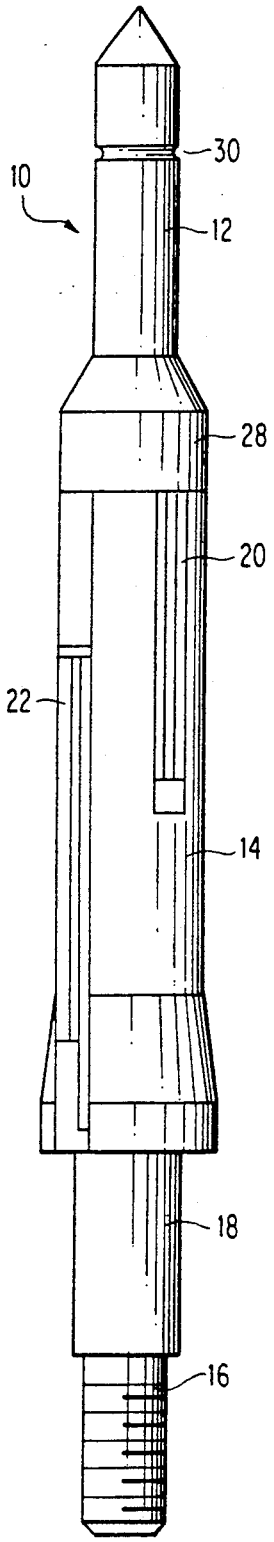
FIG. 1 is an isometric view of a broadhead with fully retracted blades and reflects the "in flight" configuration of the broadhead.
Figure 2:
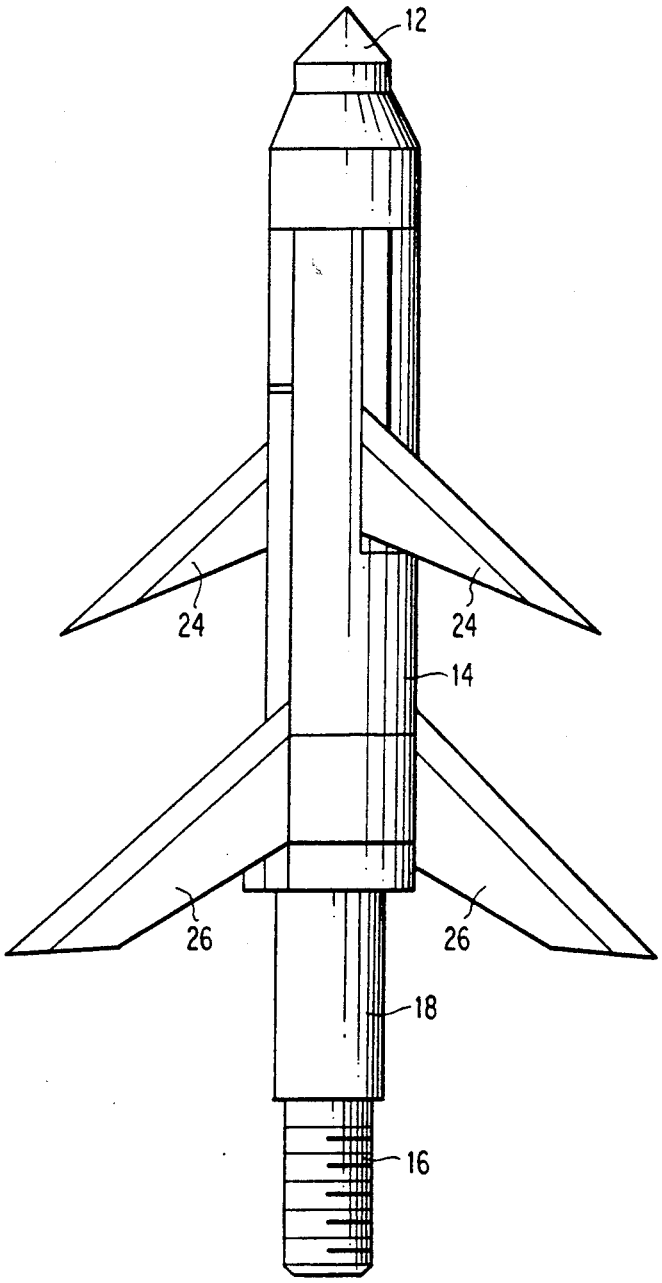
FIG. 2 is an isometric view of the broadhead shown in FIG. 1 with fully opened blades and reflects the "impact" configuration of the broadhead.

Referring now to the drawings, and more particularly to FIGS. 1 and 2, there is shown a broadhead 10 in its "in flight" and "impact" configurations, respectively, having a pointed plunger tip 12, a cylindrical body 14, and a threaded bottom 16. The broadhead 10 is secured to an arrow shaft (not shown) by threaded bottom 16. Shoulder 18 fits within a counterbore in the top of the arrow shaft. The cylindrical body 14 has slots 20 and 22 which house upper and lower pairs of cutting blades 24 and 26, respectively. Preferably, the slots 20 and 22 are positioned such that the blades 24 and 26 extend at each 90° increment around the cylindrical body 14.

In operation, the plunger tip 12 is fully extended as shown in FIG. 1 when the broadhead is in flight. As described below, the cutting blades 24 and 26 are secured to the plunger 12 on pivot pins so that when the plunger tip 12 moves towards the cylindrical body 14, the cutting blades 24 and 26 are cammed open to the impact configuration shown in FIG. 2 when an animal is struck by the arrow. A tubular restraint 11 which encircles the body 14 can be used to hold the blades 26 within the body during the flight of the arrow. The tubular restraint 11 is preferably made of a plastic, vinyl, rubber, cardboard, or other cuttable material, and is installed on the broadhead 10 over the slots 22 when the broadhead is in the in flight configuration of FIG. 1. The tubular restraint 11 should be strong enough to withstand forces which tend to force the cutting blades 26 outward when the arrow is shot, i.e., due to inertia, the plunger 12 will tend to remain stationary when the arrow is shot, but the cylindrical body 14 will be urged forward with the arrow shaft. Hence, the tubular restraint 11 must be strong enough not to be cut upon shooting the arrow and will keep the plunger 12 forward in flight. However, the tubular restraint 11 must be weak enough to be cut when the plunger 12 impacts against an animal so that the blades 24 and 26 can be forced outwardly to cause maximum hemorrhaging. A C-shaped ring (not shown), housed within cap 28 locks the blades 24 and 26 in their open configuration when it fits into the channel 30 encircling the plunger tip 12 towards its top section. In addition, as will be described below, the C-shaped ring can be used as an alternative means to the tubular restraint 11 for keeping the plunger 12 and cutting blades 24 and 26 in their in flight configuration.

Figure 3:
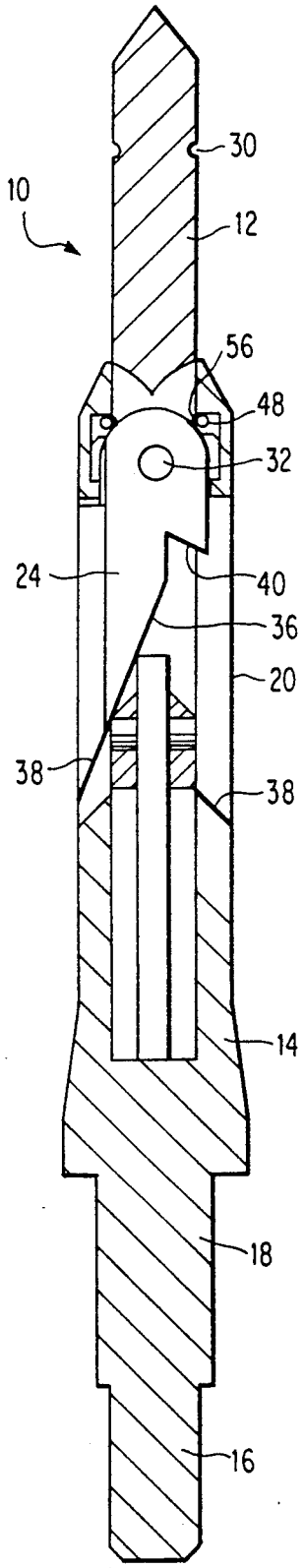
FIG. 3 is a cross-sectional side view of a broadhead in the in flight configuration showing one upper blade in its fully retracted position.
Figure 4:
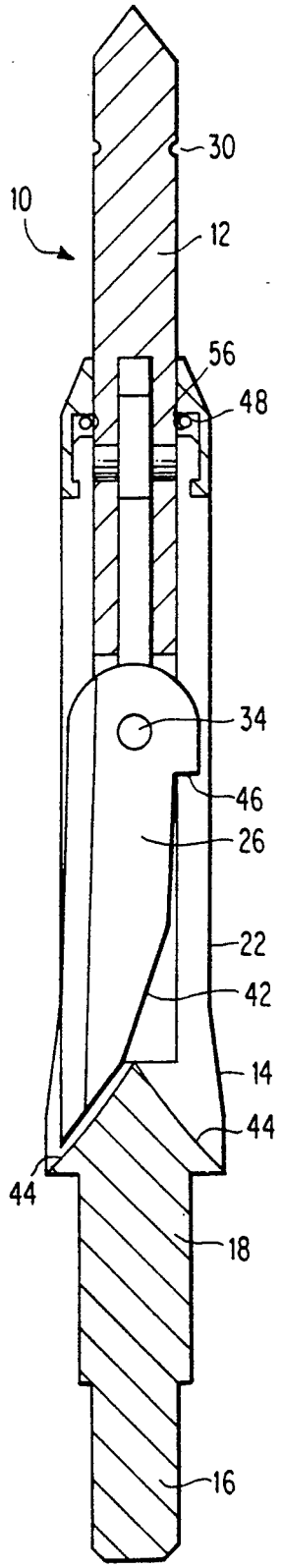
FIG. 4 is a cross-sectional side view of the broadhead shown in FIG. 3 taken 90° therefrom showing one lower blade in its fully retracted position.
Figure 7:
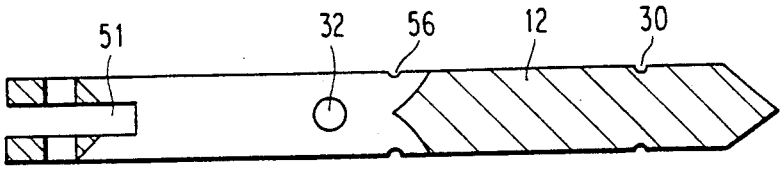
FIG. 7 is a cross-sectional side view of a plunger tip showing the pin position of the upper pair of blades.
Figure 8:
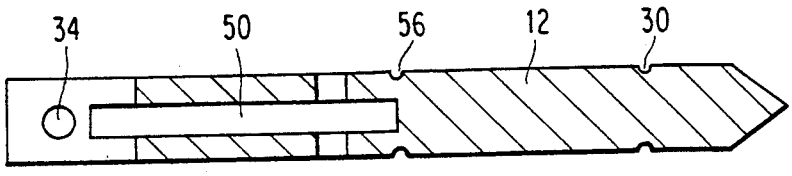
FIG. 8 is a cross-sectional side view of the plunger tip shown in FIG. 7 taken 90° therefrom showing the pin position of the lower pair of blades.
Figure 9:
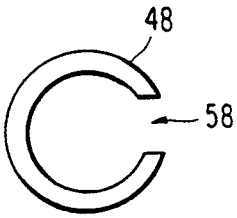
FIG. 9 is a plan view of a C-shaped ring used to lock the plunger in position.
Figure 10:
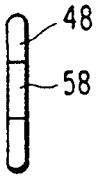
FIG. 10 is a side view of the C-shaped ring shown in FIG. 9.

Referring now to FIGS. 7 and 8 in addition to FIGS. 3 and 4, the upper blades 24 fit within slot 50 and are connected to the plunger 12 by pivot pin 32 and the lower blades 26 fit in slot 51 at the base of the plunger 12 and are connected to the plunger by pivot pin 34. Preferably, a frictional engagement exists between the plunger 12 at slots 50 and 51 and the blades 24 and 26 which will aid in holding the blades 24 and 26 in the body 14 during the flight of the arrow. The frictional engagement can be provided by adding a bent washer, belleville washer, lock washer or some other additional element on the pivot pin between the pairs of blades 24 and 26 within the slots 50 and 51 as described in the co-pending application having Ser. No. 07/460,299 or by sizing the width of the slots 50 and 51 so that the pairs of blades 24 or 26 fit snugly within their respective slots or appropriately deforming the blades or by some other suitable mechanism.

Referring now to FIGS. 3, 4, 7, 8, 9, and 10, the C-shaped ring 48 positioned within the space between the cap 28 and the cylindrical body 14 has a smaller diameter than the plunger tip 12; therefore, the force of the impact must open the C-shaped ring slightly so that it may ride against the plunger tip 12 as it slides into the cylindrical body 14 and then snap into the channel 30 to lock the blades 24 and 26 open. The C-shaped ring 48 holds the plunger tip 14 in its fully extended position shown in FIGS. 3 and 4 by resting within a shallow, rear channel 56. Since the plunger tip 12 is larger in diameter than the C-shaped ring 48, the plunger tip 12 is prevented from moving during flight. An alternative method for holding the plunger tip 12 in its extended position is to have a plunger tip 12 fabricated which increases in diameter towards the front of the plunger tip 12. In the alternative method, the outwardly tapered sidewall of the plunger tip 12 would provide a functionally similar result as the shallow, rear channel 56. Upon impact with the animal, the C-shaped ring 48 is deformed by enlarging at gap area 58 so that it may ride against the outside wall of the plunger tip 12. The C-shaped ring 48 snaps into the front channel 30 to lock the blades 24 and 26 in the "impact" position so that a deer may not pull the broadhead 10 out of its body. It is also anticipated that other types of rings such as 0-rings, etc. could fulfill the function of C-shaped ring 48 and would perform as described above.

Figure 5:
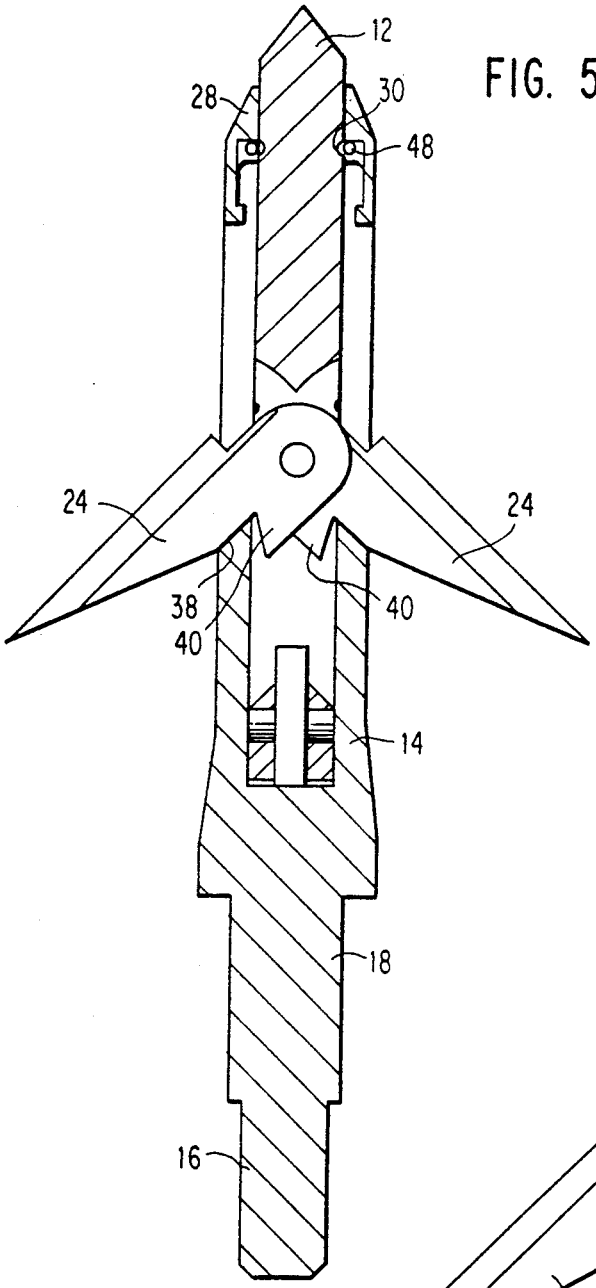
FIG. 5 is a cross-sectional side view of a broadhead in the impact configuration showing the upper pair of blades in their open position.
Figure 6:
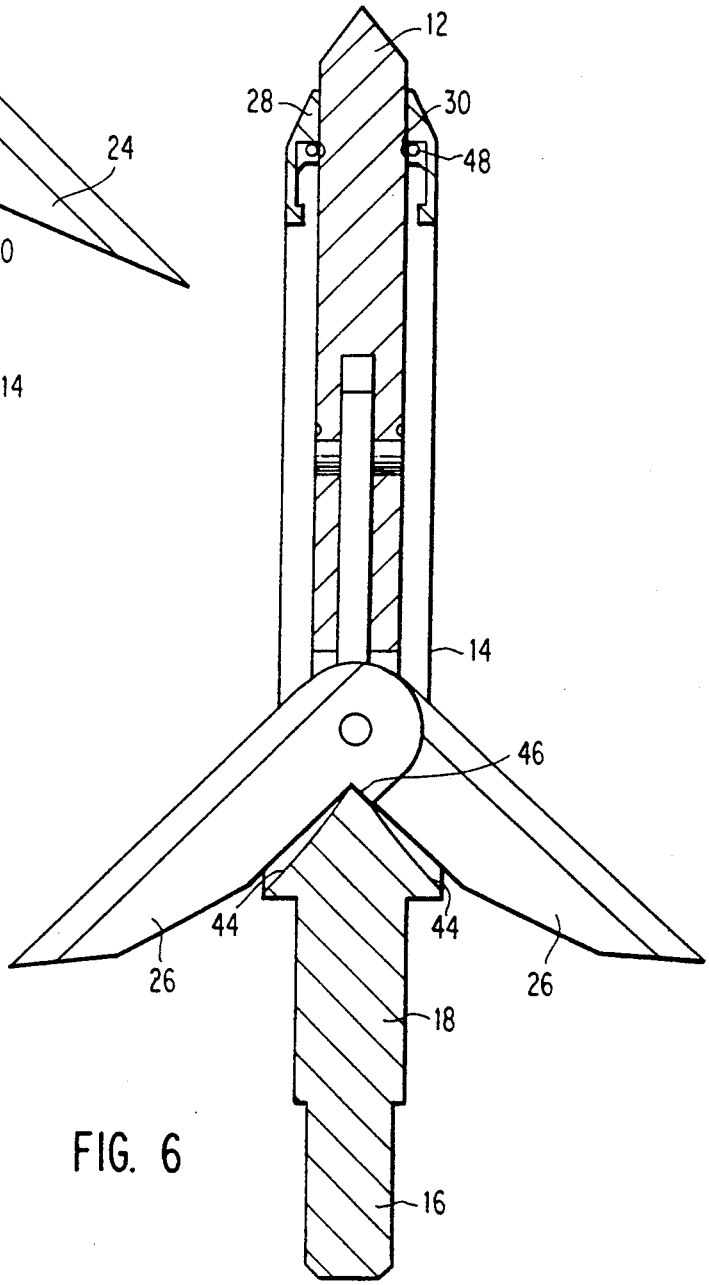
FIG. 6 is a cross-sectional side view of the broadhead shown in FIG. 5 taken 90° therefrom showing the lower pair of blades in their open position.
Figure 11:
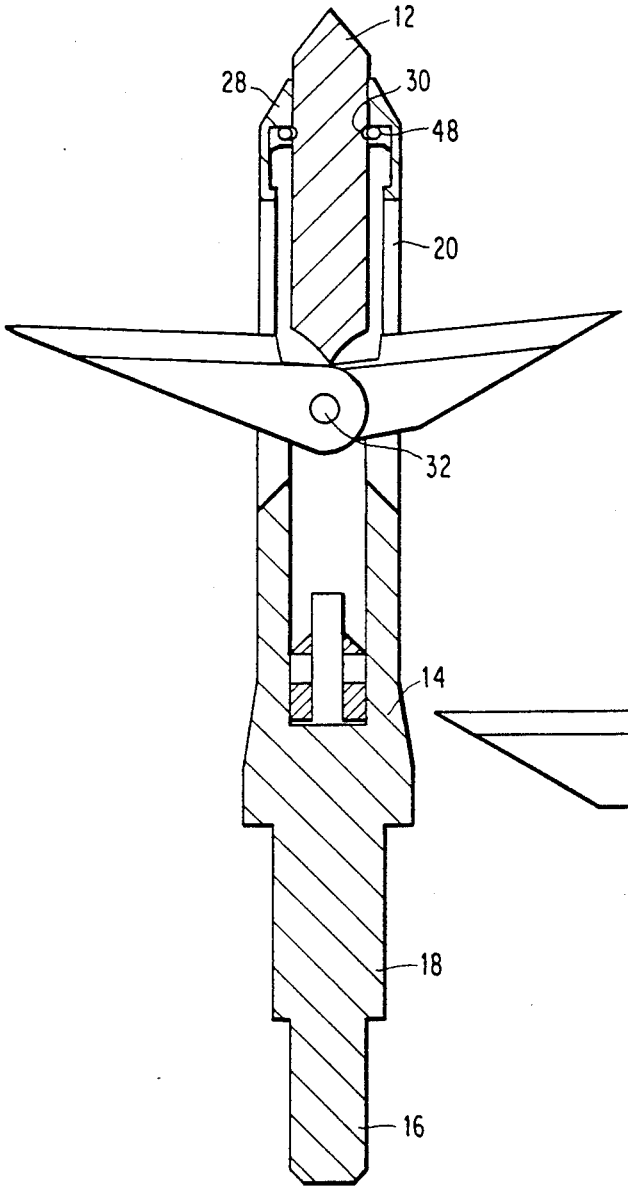
FIG. 11 is a cross-sectional side view of a broadhead in the impact configuration showing the upper pair of blades pivoted forward from their open position.
Figure 12:
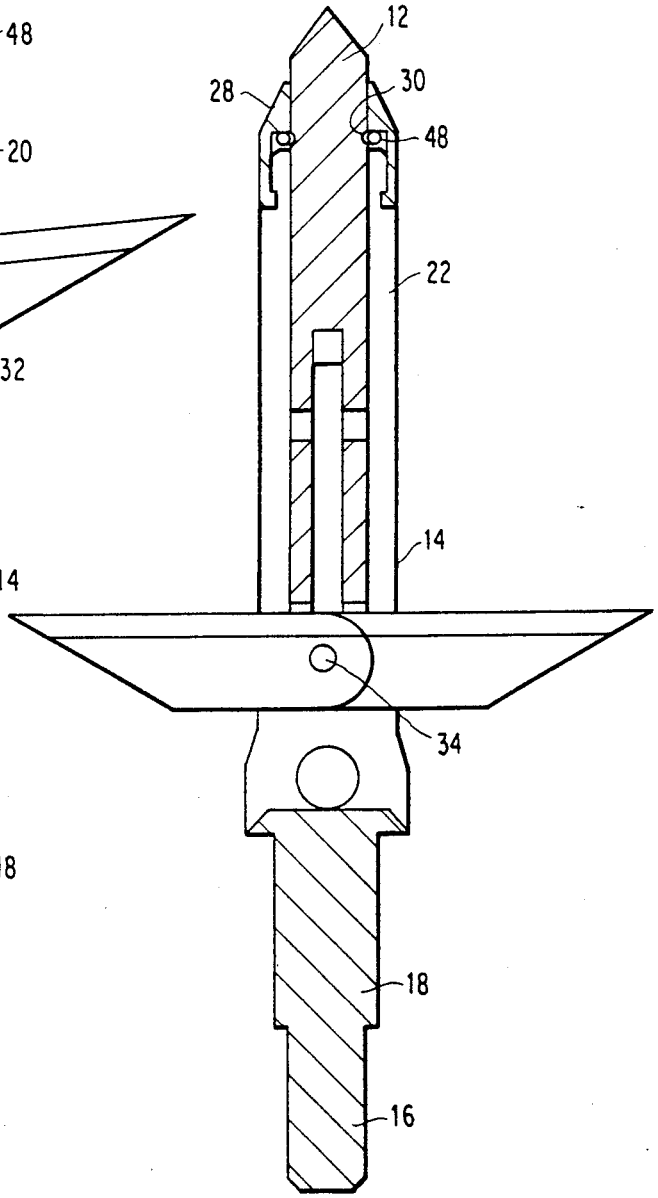
FIG. 12 is a cross-sectional side view of the broadhead shown in FIG. 11 taken 90° therefrom showing the lower pair of blades pivoted forward from their open position.
Figure 1:
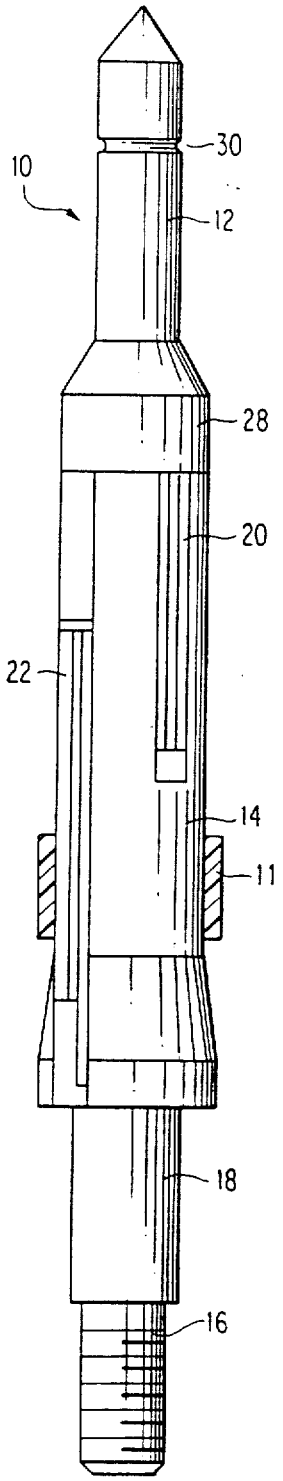
Figure 3:
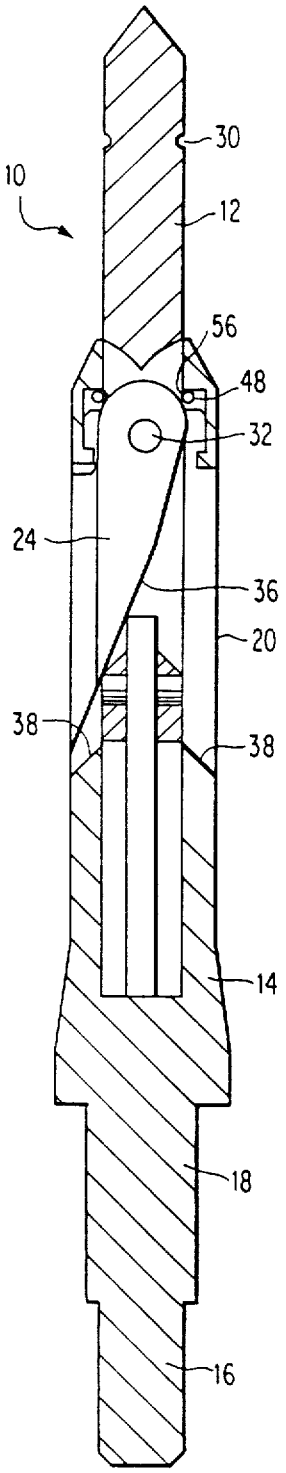
Figure 4:
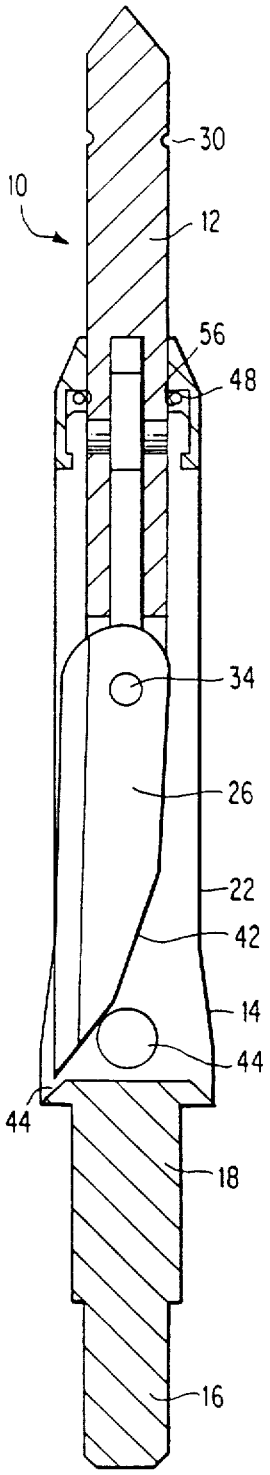
Figure 5:
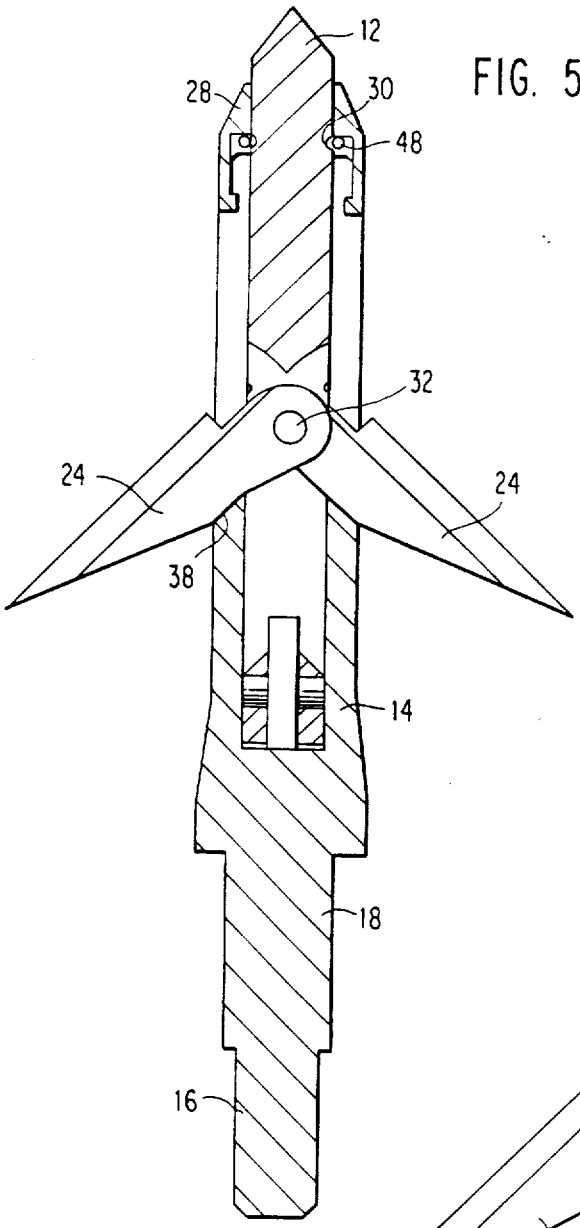
Figure 6:
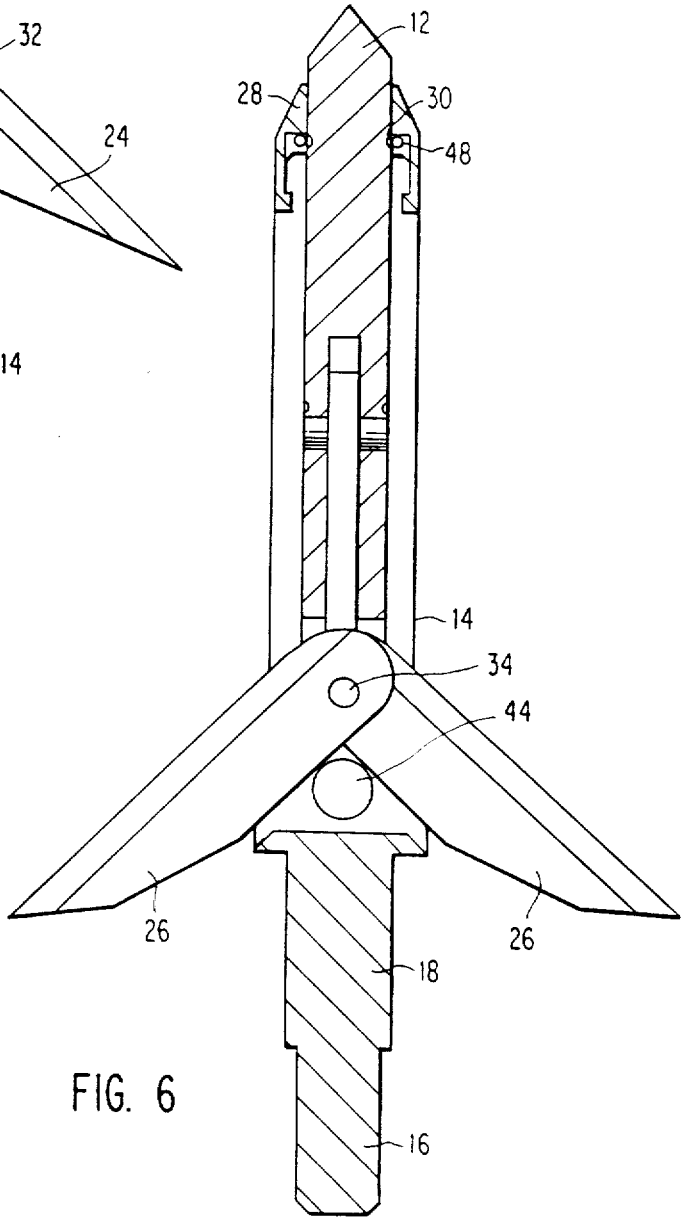

Referring now to FIGS. 5, 6, 11, and 12, which show cross-sectional views taken at 90° increments with respect to one another of a broadhead 10 in its "impact" configuration in FIGS. 5 and 6 and in its "non-barbed" configuration shown in FIGS. 11 and 12, the upper blades 24 are cammed open on surface 38 and the bottom blades 26 are cammed open against the pin 44 when the plunger 12 is forced into the cylindrical body 14. The C-shaped ring 48 positively locks the blades 24 and 26 in their open positions so that the animal will have maximum hemorrhaging. To comply with gaming laws in some states, the blades 24 and 26 are able to pivot forward within the slots 20 and 22 on pivot pins 32 and 34, respectively, to a non-barbed configuration.

Figure 13:
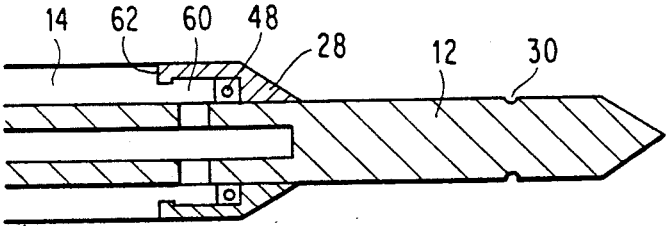
FIG. 13 is an enlarged cross-sectional side view of the plunger and cap of the broadhead shown in FIGS. 3 and 4.
Figure 14:
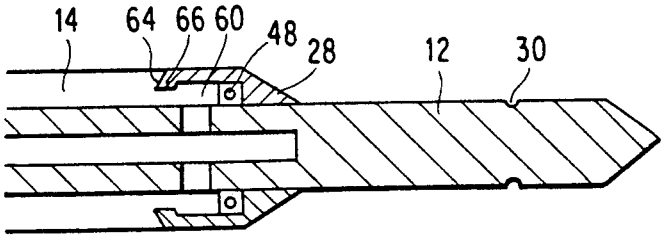
FIG. 14 is an enlarged cross-sectional side view of an alternative plunger and cap for the broadhead shown in FIG. 13.

Referring now to FIGS. 13 and 14 which show the manner in which the cylindrical body 14 fits together with the cap 28. A threaded section 60 at the end of the body 14 mates with a threaded section inside the cap 28. With reference back to FIGS. 1 and 2, the threaded section 60 is split four ways for slots 20 and 22. FIG. 13 shows that the base of the cap 28 meets flush with a flat shoulder 62 of the cylindrical body 14. While the arrangement shown in FIG. 13 does work properly, there is a tendency, if the cap 28 is screwed down too tightly, for the cylindrical body 14 to be forced inward such that it frictionally hinders the plunger 12 from sliding freely into the body 14. It has been discovered that a bevelled shoulder 64 on the cylindrical body 14 and a corresponding bevelled base 66 on the cap 66 provides a lifting function as the cap 28 is screwed tight which avoids having the cylindrical body 14 squeezed inwardly against the plunger 12.

While the invention has been described in terms of its preferred embodiment where two pairs of cutting blades are positioned on pivot pins connected to a front plunger tip at different heights and are spaced at 90° increments about the cylindrical body, those skilled in the art will recognize that the number of blades and their placement relative to the cylindrical body can be varied within the spirit and scope of the appended claims.

Having thus described our invention, what we desire to secure by Letters Patent is the following:

1. A broadhead, comprising:

a body attachable to an arrow shaft, said body being immovable relative to an arrow shaft once said body is attached to an arrow shaft;

a plunger slidable in a bore in said body;

means for alternatively holding said plunger in a first or second position relative to said body;

two pairs of cutting blades connected by pivot pins to said plunger, a first pair of cutting blades connected at a first location on said plunger, a second pair of cutting blades connected at a second location on said plunger;

means for holding said cutting blades in a retracted position within slots formed in said body when said plunger is in said first position; and a cam surface connected to said body positioned to open at least one pair of cutting blades to an open position as said plunger moves from said first position to said second position, said first and second pairs of cutting blades being pivotable from said open position to a non-barbed position relative to said body when said plunger is in said second position.

2. A broadhead, comprising:

a body attachable to an arrow shaft, said body being immovable relative to an arrow shaft once said body is attached to an arrow shaft;

a plunger slidable in a bore in said body having a pointed end which projects out of said body from said bore in said body, said plunger being slidable between a first position and a second position relative to said body wherein said pointed end of said plunger is furthest from said body when said plunger is in said first position and wherein said pointed end of said plunger is closest to said body when said plunger is in said second position;

a cutting blade mounted on a pivot pin connected to said plunger, said cutting blade having a pivoting end which pivots on said pivot pin and an opening end which opens away from said body;

a means for holding said cutting blade in a retracted position wherein said pivoting end of said cutting blade is closer to said pointed end of said plunger than said opening end of said cutting blade and wherein said opening end of said cutting blade is held at a first point close to said body; and a cam surface on said body positioned to open said opening end of said cutting blade to a second point away from said body as said plunger moves from said first position to said second position, said cutting blade being pivotable from said second point away from said body to a third point to form a non-barbed configuration of said cutting blade and said body when said plunger is in said second position.

3. A broadhead, comprising:

a body attachable to an arrow shaft, said body being immovable relative to an arrow shaft once said body is attached to an arrow shaft;

a plunger slidable in a bore in said body having a pointed end which projects out of said body from said bore in said body, said plunger being slidable between a first position and a second position relative to said body wherein said pointed end of said plunger is furthest from said body when said plunger is in said first position and wherein said pointed end of said plunger is closest to said body when said plunger is in said second position;

first and second pairs of cutting blades mounted on first and second pivot pins connected to said plunger at first and second locations, respectively, each of said cutting blades of said first and second pairs of cutting blades having a pivoting end which pivots on said first or second pivot pin and an opening end which opens away from said body;

a means for holding each of said cutting blades in a retracted position wherein said pivoting end of said cutting blade is closer to said pointed end of said plunger than said opening end of said cutting blade and wherein said opening end of each of said cutting blades is held at a first point close to said body; and cam surfaces on said body positioned to open said opening end of each of said cutting blades to a second point away from said body as said plunger moves from said first position to said second position, each of said cutting blades being pivotable from said second point away from said body to a third point to form a non-barbed configuration of said cutting blade and said body when said plunger is in said second position.

* * * * *

UNITED STATES PATENT AND TRADEMARK OFFICE

CERTIFICATE OF CORRECTION

PATENT NO. : 5,082,292

DATED : January 21, 1992

INVENTOR(S) : Riley Puckett et al.

It is certified that error appears in the above—identified patent and that said Letters Patent is hereby corrected as shown below:

In the drawings:

Please delete Figures 1, and 3-6 which appear in the printed patent and substitute the attached three (3) sheets of drawings containing the correct Figures 1, and 3-6.

Signed and Sealed this

Eighteenth Day of May, 1993

*Attest:*

Michael K. Kirk

MICHAEL K. KIRK

*Attesting Officer*

*Acting Commissioner of Patents and Trademarks*